United States Patent [19]

Wingate-Hill et al.

[11] Patent Number: 5,022,446

[45] Date of Patent: Jun. 11, 1991

[54] COMPRESSION LOG DEBARKING APPARATUS

[75] Inventors: Robin Wingate-Hill, Curtin; Ian J. MacArthur, Melba, both of Australia

[73] Assignee: Commonwealth Scientific and Industrial Research Organisation, Australia

[21] Appl. No.: 457,902

[22] Filed: Dec. 27, 1989

Related U.S. Application Data

[63] Continuation-in-part of Ser. No. 260,551, Oct. 20, 1988, abandoned.

[30] Foreign Application Priority Data

Dec. 20, 1987 [AU] Australia ..... PI4967

[51] Int. Cl.[5] ..... B27L 3/00

[52] U.S. Cl. ..... 144/208 F; 144/208 R; 144/340

[58] Field of Search ..... 144/2 Z, 208 R, 208 F, 144/340, 341

[56] References Cited

U.S. PATENT DOCUMENTS 2,945,523 7/1960 Jenkins ..... 144/208 F
3,263,720 8/1966 Brock et al. ..... 144/208 F
3,587,685 6/1971 Morey ..... 144/208 F
4,396,048 8/1983 Dubey ..... 144/208 F

*Primary Examiner*—W. Donald Bray
*Attorney, Agent, or Firm*—Sughrue, Mion, Zinn, Macpeak & Seas

[57] ABSTRACT

Apparatus for debarking a log using the compression debarking technique includes rollers which apply radial pressure to the log to separate the bark from the wood of the log. Pairs of rollers mounted in a bogie-like arrangement on the end of respective arms bear against the log. At each roller contact location, the log is also contacted by either a fixed roller or another pair of bogie-mounted rollers. At least two of the rollers of each set are driven by a reversible motor, to rotate the log while pressure is applied to it. The (preferably variable) angle which the planes of rotation of the rollers make with the longitudinal axis of the log ensures that the log is transported through the set of rollers as pressure is applied to the log. Cutting means, such as a knife blade on the outer surface of at least one roller, slices the bark which has been separated from the wood of the log, so that strips of bark fall from the log. The invention is especially suitable for removing thick stringy, fibrous bark from logs.

14 Claims, 6 Drawing Sheets

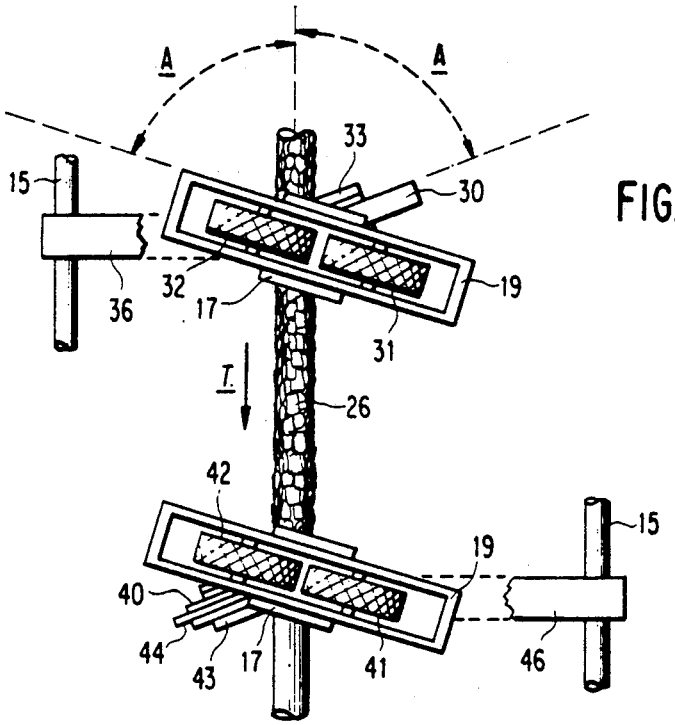
FIG. 4
FIG. 5
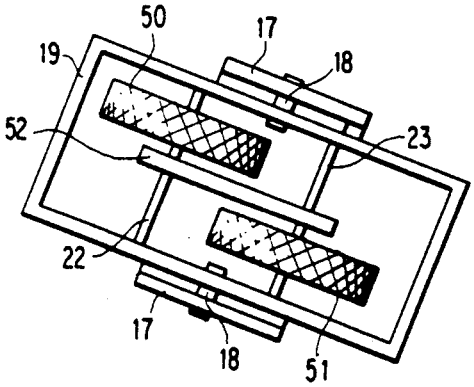
FIG. 6
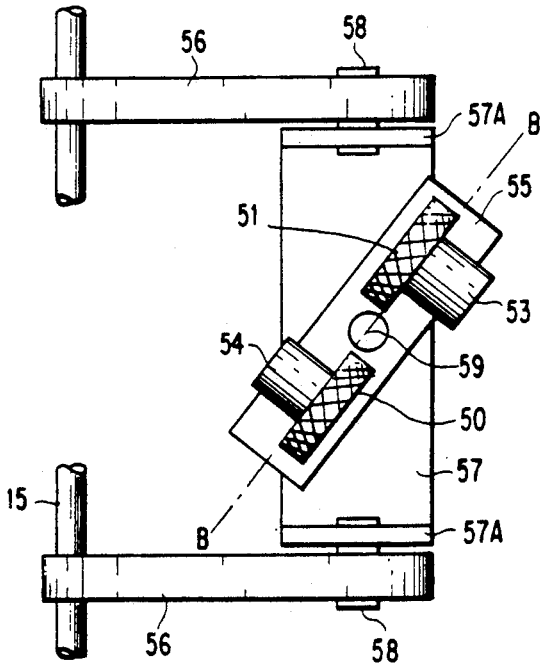

COMPRESSION LOG DEBARKING APPARATUS

CROSS—REFERENCE

This is a continuation-in-part application in respect of U.S. patent application Ser. No. 07/260,551, filed Oct. 20, 1988 now abandoned.

TECHNICAL FIELD

This invention concerns the removal of bark from logs, and more particularly concerns apparatus for the compression debarking of logs. It is particularly suitable for the removal of bark from eucalypt logs having thick, stringy, fibrous bark which cannot be removed effectively by other debarking mechanisms.

BACKGROUND TO THE INVENTION

There are a number of techniques for removing the bark from logs.

Probably the best known debarkers are those which use rollers carrying teeth on their outer surfaces. The teeth are designed and positioned to rip pieces of bark from a log passing between the rollers until all the bark is removed. Examples of such debarkers are described in the specifications of U.S. Pat. Nos. 3,363,720 (to G. W. Brock and H. J. Merrifield) and 3,587,685 (to N. K. Morey and L. N. Smith).

A similar approach to debarking is found in the drum debarkers. With a drum debarker, logs are passed through a rotating drum which has internal vanes or ribs. As the logs are tumbled within the drum, they strike each other and the vanes or ribs within the drum, and these impacts act to tear the bark from the logs. Descriptions of drum debarkers are found in the book entitled "Handbook of Pulp and Paper Technology" (second edition), edited by K. W. Britt and published by Van Nostrand Reinhold Company, at pages 103 and 122, and also in the book entitled "Forest Products, their Sources, Production and Utilization", by Panshin, Harrer, Bethel and Baker, published by McGraw-Hill Book Company (second edition, 1962), at pages 332 to 335. Such drum debarkers are unsuitable for debarking stringy-bark eucalypts and other species in Australia.

The rotary or ring debarkers—a number of models have been used—cut the bark with a knife before it is stripped from a log. A typical ring debarker has a hollow rotor unit within which are mounted inwardly projecting cutters or barking tools. The cutters or barking tools are rotated about a log as it is moved through the rotor to cut or strip the bark from the log. Examples of developments in rotary debarkers are found in the specifications of Australian patents Nos. 479,105 (to Kokum Industri Aktiebolag) and 501,776, (to V. L. Valo), and Australian patent applications Nos. 21267/83 (Hutson) and 66304/86 (Fuji Kogyo K K).

A third debarking technique, known as compression debarking, which is suitable for removing bark from stringy-bark eucalypts, involves the application of substantial pressure to the bark of a log, to break the bond between the bark and the wood, and leave a tube of bark surrounding, but separated from, the wood. The tube of bark is then cut into strips by a knife, which is typically mounted on a roller downstream from the pressure-applying rollers, although the cutting of the bark may occur before, during or after the application of pressure to the bark. Examples of this type of debarker are described in the specification of Australian patent application No. 82427/87, now Australian Patent No. 604,514 (in the name of Commonwealth Scientific and Industrial Research Organisation) and in the specification of the corresponding U.S. patent application Ser. No. 131,485 filed Dec. 10, 1987, now U.S. Pat. No. 4,875,511.

Other debarking techniques include hydraulic barkers using water jets under high pressure, flails (see the specification of Australian patent No. 506,204 to L. J. Emmins), "knocking" the bark from a log (see the specification of Australian patent No. 511,333 to G. A. Williames), and, of course, manual removal of the bark with axes and the like.

The present invention concerns the third debarking technique referred to above, compression debarking. Two recent proposals for an improved approach to debarking by this technique were the subject of the aforementioned Australian patent application No. 82427/87, in the name of Commonwealth Scientific and Industrial Research Organisation. One of those proposals (excluded from the specification by amendment and thus not featured in the specification of Australian Patent No. 604,514) involves the passage of a log through the open-ended passage defined by three rollers which are mounted on a frame with their axes of rotation arranged angularly relative to each other and to the elongate direction of the passage. Thus, instead of being parallel to each other, the axes of the rollers are skewed relative to the elongate direction of the passage and the rollers form a tapered or converging passage. The rollers all rotate in the same direction, and at least two of the rollers are mounted resiliently on their support frame, to enable the cross-sectional dimension of the passage to change to allow logs of various size to be debarked. The cylindrical outer surface of each roller is grooved or is otherwise roughened, or is provided with welded-on bars or the like. The rollers may be rotated at different speeds.

A log that is to have its bark removed is fed endwise into the passage and passes through it under the influence of the grip on the log by the outer surfaces of the rollers combined with the rotation of the rollers. As the log is drawn through the tapered passage, it is subjected to increasing radial compressive forces, and these forces cause the bark to separate from the wood of the log. One of the rollers is provided with a circumferential "knife" on its outer surface, to cut through the loose bark which tends to remain as a tube around the body of logs of rough, stringy-barked eucalypts and the like.

The second proposal disclosed in the specification of the aforementioned Australian patent application No. 82427/87 (now the sole subject of Australian Patent No. 604,514 and U.S. Pat. No. 4,875,511) involves the provision of at least two pairs of rollers, each pair mounted with the axes of its rollers parallel to each other, and at an angle to the axial direction of the other pair of rollers. The outer surface of each roller is concave, and the pairs of rollers are mounted in spaced apart relationship along the path followed by a log—one pair of rollers thus being effectively downstream of the other pair or pairs. A log to be de-barked is passed between the rollers of the first pair, then through the second pair of rollers, and then between other pairs of rollers if present. The rollers of at least the first pair are grooved or otherwise roughened to provide a firm grip on a log. Each roller of the final two pairs of rollers is provided with one or more helically-positioned knife blades on its outer surface.

When a log to be debarked is fed into the first pair of rollers, the first rollers apply a compressive force to the log to such an extent that the bond between the bark and the wood is broken and the bark separates from the timber body of the log. The bark remains as a tube of enlarged cross-section around the timber body. Knife blades affixed to the rollers cut the tubular bark into strips, which fall from the log. This arrangement is effective with logs having a substantially uniform cross-section with a diameter approximately equal to twice the radius of curvature of the concave shape of the rollers. However, it exhibits problems when the logs are not essentially circular in cross-section and when the logs have large branch stubs and other irregularities, which tend to block the forward movement of the log through the pairs of rollers.

DISCLOSURE OF THE PRESENT INVENTION

It is an object of the present invention to provide improved forms of compression debarking equipment of the rotating log type, in which the log is rotated during the application of pressure to separate the bark from the underlying timber. This objective is achieved by providing at least two sets of rollers in the debarking equipment, each set of rollers defining an aperture through which a log is passed. Each set of rollers consists of either three rollers or four rollers.

In the case of sets of three rollers, in each set of rollers, one roller is mounted on a frame so that its location relative to the aperture it helps to define is fixed and the other two rollers are mounted in a bogie-type arrangement. The bogie arrangement is moveable relative to a log positioned in the aperture to enable the three rollers to apply pressure to the bark of the log. The two bogie-mounted rollers of each set are driven to rotate in the same direction; the single roller may be driven but will usually be free to rotate about its own axis. The single roller in the last set of rollers (which is the second set of rollers when only two sets of rollers are used) will usually be a roller provided with at least one cutting blade, although the cutting of the bark may be effected at the beginning, during, or after the passage of the log through the compression debarker.

If there are four rollers in each set of rollers, the four rollers will be mounted in pairs, each pair of rollers being mounted in a bogie-type arrangement. Both bogie-mounted pairs of rollers may be moveable relative to a support frame to enable the four rollers of the set of rollers to apply pressure to a log positioned in the aperture defined by the set of rollers. Normally, however, one bogie-mounted pair of rollers will be mounted fixedly relative to the support frame, and only the other pair of bogie-mounted rollers will be moveable relative to the log, to ensure that the log is held against the fixed pair of bogie-mounted rollers and pressure is then applied to the bark of the log by all four rollers of the set. Normally all four rollers will be driven. One of the rollers of the set may be provided with means to cut through bark that has been loosened from the timber centre of the log by the applied pressure, although, as noted above, the cutting of the bark may be effected separately of the passage of a log through the rollers.

Thus, according to a first aspect of the present invention, there is provided apparatus for removing the bark from logs by the compression debarking technique, the equipment comprising:

(a) at least two sets of rollers, each set of rollers being mounted in spaced apart relationship relative to the other set or sets of rollers, each set of rollers defining an aperture through which a log may pass as it traverses the apparatus; in which each set of rollers comprises:

(i) a first roller and a second roller mounted for rotation about respective, spaced apart, parallel axles supported in a bogie-like arrangement by a first support member, said first support member being moveable relative to a support frame and to a log positioned in said aperture, to enable said first and second rollers to apply pressure to the log; and (ii) at least one further roller but not more than two further rollers, said or each further roller being mounted for rotation about a respective axle supported by a second support member which is fixed in relation to said support frame, said or each further roller applying pressure to the log as a consequence of the pressure applied to the log by the first and second rollers;

(b) motor means to drive at least said first and second rollers of each set in the same direction of rotation about their respective axles;

(c) respective movement means associated with each set of rollers to cause its associated arm to move the respective first and second rollers towards and away from the log and to apply pressure thereto; and (d) cutting means adapted to cut through the bark of the log.

Normally, as indicated above, the cutting means will comprise at least one cutting blade on the outer surface of one of the rollers rollers encountered by the log as it traverses the debarking equipment.

In a preferred form of this arrangement, there are two further rollers, which are mounted in a bogie-like arrangement in a manner similar to that of the first and second rollers. In this arrangement, each bogie-mounted pair of rollers are preferably narrow rollers, offset relative to each other, so that each roller of these pairs of rollers will provide traction on a log of small diameter, relative to the diameter of the rollers, that is being debarked by the equipment of the present invention.

It is also preferred that each support member is controllably rotatable about an axis that is orthogonal to its bogie axle to vary the pitch of the rollers relative to a log passing through the equipment. In this form of the present invention, the rollers each preferably comprise a steel wheel to which polyurethane material is firmly attached, the polyurethane material being shaped to be part of a sphere having a radius which is substantially equal to the radius of the steel wheel.

These and other features of the debarking equipment of the present invention will be more clearly understood from the following description of embodiments of such equipment. These embodiments are provided by way of example only. In the following description, reference will be made to the accompanying drawings.

BRIEF DESCRIPTION OF THE DRAWINGS

FIG. 4 is a partly schematic top view of the equipment illustrated in FIGS. 2 and 3, with a log passing substantially horizontally through the equipment.

FIG. 5 illustrates one arrangement of a driven pair of rollers in a bogie-like support member.

FIG. 6 is a view, in a direction similar to that of FIG. 4, of a preferred arrangement of a driven pair of rollers in a bogie-like support member.

DETAILED DESCRIPTION OF THE ILLUSTRATED EMBODIMENTS

FIG. 1, as indicated above, illustrates the roller configurations used in the two aspects of the present invention and in the embodiments described in the specification of Australian patent application No. 82427/87 (but only the FIGS. 1(*d*) and 1(*e*) embodiments are included in the specification of Australian Patent No. 604,514). Each pair of drawings in FIG. 1 illustrate an end view of, and a view from above, a log passing through compression debarking equipment and having its bark removed. Specifically, FIGS. 1(*a*), 1(*b*) and 1(*c*) show equipment in which the log is rotated about its long axis as it passes through the compression debarking equipment, and FIGS. 1(*d*), 1(*e*) and 1(*f*) illustrate the roller arrangements of compression debarking equipment in which the log is debarked without rotation of the log about its long axis. The arrangements of FIGS. 1(*a*), 1(*d*) and 1(*e*) are those described in the specification of Australian patent application No. 82427/87. The arrangement of FIG. 1(*b*) corresponds to that illustrated in FIGS. 2, 3 and 4 of the present specification. The arrangements of FIG. 1(*c*) and FIGS. 5, 6, 7 and 8 correspond. The roller arrangement of FIG. 1(*f*) is that used in a form of log debarking equipment which is not described in the present specification.

Figure 1A:
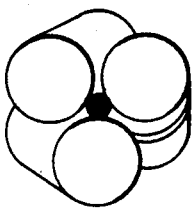
FIG. 1a PRIOR ART
FIG. 1 is a schematic diagram illustrating the roller arrangements of the present invention and of the inventions described in the specification of the aforementioned Australian patent application No. 82427/87.
Figure 1B:
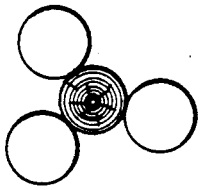
Figure 1C:
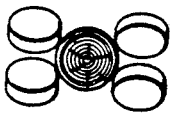
Figure 1D:
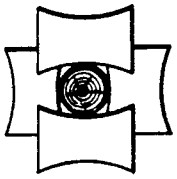
FIG. 1d PRIOR ART
Figure 1E:
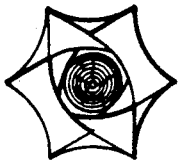
FIG. 1e PRIOR ART
Figure 1F:
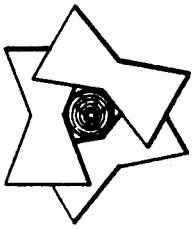
Figure 1A:
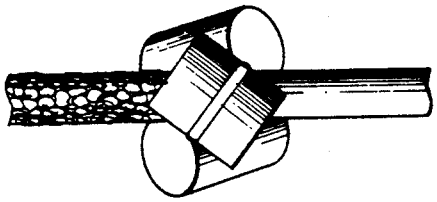
Figure 1B:
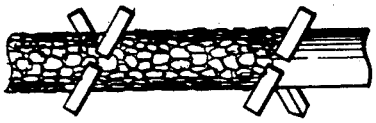
Figure 1C:
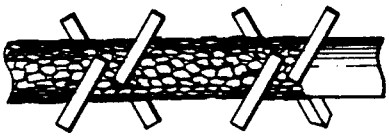
Figure 1D:
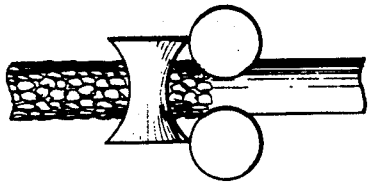
Figure 1E:
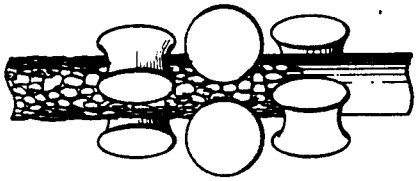
Figure 1F:
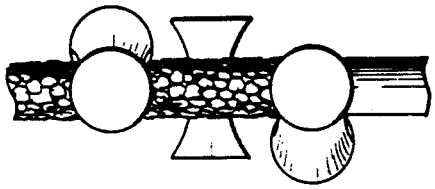
Figure 2:
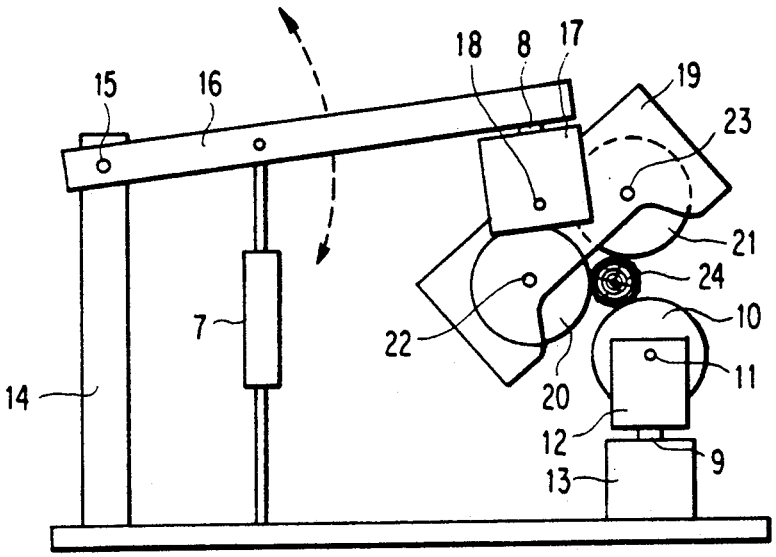
FIG. 2 is a partly schematic view, in the direction of travel of a log, of a set of three rollers of one form of the equipment which constitutes the first aspect of the present invention, with a thin log passing through the aperture that is established by the set of rollers.
Figure 3:
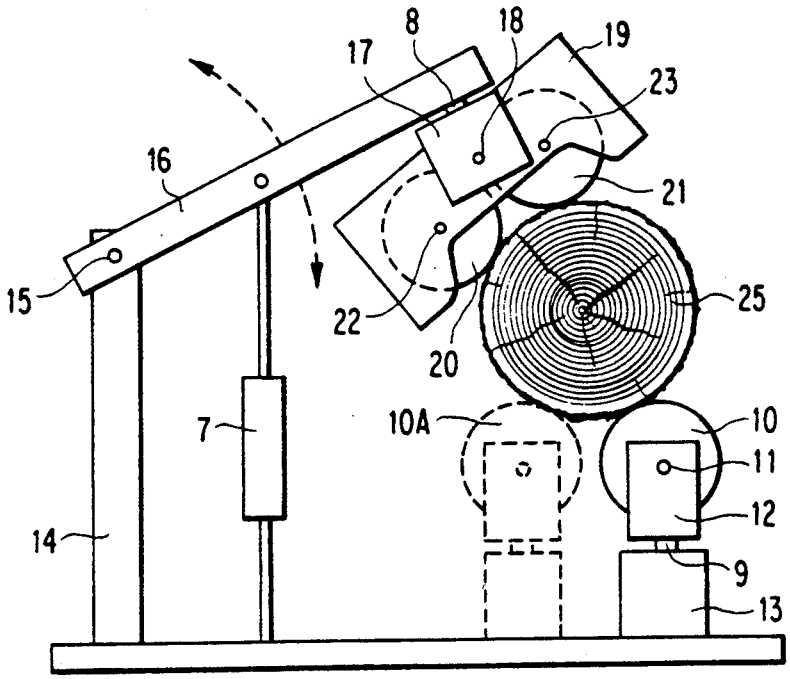
FIG. 3 is similar to FIG. 2, but with a log of large diameter passing through the aperture that is established by the set of rollers.

The set of rollers shown in FIGS. 2 and 3 typifies a set of rollers for use in a basic mill installation of the present invention. It consists of a first roller 20, a second roller 21 and a third roller 10. The third roller 10 is rotatable about an axle 11 that is supported by a supporting bracket 12. The supporting bracket 12 is rotatably mounted on a swivel member 9 on a rigid frame member 13. Another frame member 14 (which is shown as part of a general framework of the equipment) supports an axle 15 that provides a pivot axis for one end of an arm 16. The other end of the arm 16 carries a swivel member 8 upon which a support bracket 17 is rotatably mounted. A supporting member 19 forms, with the first and second rollers 20 and 21, and their associated axles 22 and 23, a bogie-like arrangement that is connected to the support bracket 17. The rollers 20 and 21 are mounted on the supporting member 19 with their outer surfaces in close proximity to each other.

A hydraulic ram 7 is used to control the position of the support bracket 17 relative to the third roller 10. However, mechanical engineers will appreciate that the hydraulic ram may be replaced by alternative movement means for the arm 16, such as a worm and nut arrangement, or a rack and pinion arrangement. The hydraulic ram 7 (or its mechanical equivalent) of FIG. 2 acts not only to ensure that the log 24 is brought into contact with the rollers 10, 20 and 21, but also to apply, through these rollers, a pressure upon the bark which is sufficient to separate the bark from the wood of the log.

With this arrangement, as shown in FIG. 2, a log 24 that has a small diameter relative to the diameter of the rollers 10, 20 and 21, when inserted between the set of three rollers, is contacted by all three rollers 10, 20 and 21 when the ram 7 brings the support member 17 towards the roller 10.

FIG. 3 illustrates how a log 25 having a large diameter relative to the rollers 10, 20 and 21 can also be transported through this set of rollers without having to change any constructional aspect of the rollers and their mounting arrangements. The dashed outline shows the offset, relative to the log, of the third roller 10A of a second set of rollers. The first and second rollers of the second set of rollers have not been illustrated in FIGS. 2 and 3 as to do so would produce a cluttered and possibly confusing drawing.

In the arrangement shown in FIGS. 2 and 3, if one of the rollers 10, 20 and 21 is rotated, the log 24 or 25 will also be rotated (provided the rotating roller can "grip" the surface of the bark on the log). In practice, both of the rollers 20 and 21, will be mechanically driven, and preferably all three rollers are mechanically driven, so that they rotate in the same direction. In addition, all three of the first set of rollers in a debarking equipment based upon the arrangement shown in FIGS. 2 and 3 will have outer surfaces which are grooved, otherwise roughened, or provided with welded-on bars, spikes or the like, to achieve a suitable degree of grip on the bark of a log passing though the rollers. Furthermore, as will be seen more clearly from FIG. 4, the three rollers will have their axes at an acute angle A relative to the direction of travel T of a log passing through the equipment. This arrangement ensures that when the sets of rollers (that is, in FIG. 4, the rollers 30, 31 and 32 which form one set, and the rollers 40, 41 and 42 which form a second set) are driven, they cause the log 26 to be transported through the equipment in addition to rotating it about its longitudinal axis.

FIG. 4 illustrates—schematically—a compression (or pressure) debarking equipment, with a first set of rollers 30, 31 and 32 and a second set of rollers 40, 41 and 42 causing a log 26 to be rotated while it is transported through the equipment in the direction of the arrow T. The roller 40, however, has at least one knife or cutting edge 44 formed in, or attached to, its outer surface, to cut the loosened bark of the log 26 as it spirals past the roller 40.

The roller assemblies of FIG. 4 are connected by respective arms 36 and 46 to associated axles 15 mounted on the framework of the debarking equipment. Hydraulic rams or their mechanical equivalents (corresponding to the hydraulic rams 7 of FIGS. 2 and 3 but not shown in FIG. 4) ensure that each set of rollers maintains a significant radial applied pressure on the log 26 as it is being transported through the debarking equipment. The effect of this pressure by the rollers 30, 31 and 32 is to compress the bark as it passes through the set of rollers. This causes some expansion of the bark, so that it becomes separated from the timber body of the log. The bark then remains substantially as a tube around the body of the log until it reaches the rollers 40, 41 and 42. When the log is pressed against the roller 40, the bark is cut into at least one strip by the cutting edge(s) 44 on the outer surface of this roller.

It is well known that not all bark behaves in the same manner. Using the equipment of the present invention, the "pitch" of the rollers is adjustable to suit the type of bark on the log being debarked. To change the pitch of the rollers, the angle A (FIG. 4) is varied by rotation of the supporting members 33 and 43 (corresponding to the supporting bracket 12 of FIGS. 2 and 3) and the supporting members 17 about respective swivel axes.

An alternative arrangement of a pair of bogie-mounted rollers is shown in FIG. 5. In this arrangement, the central planes of rotation of the narrow rollers 50 and 51 are displaced laterally with regard to each other. This arrangement enables, (a) the rollers 50 and 51 to be mounted so that their outer surfaces follow different paths over the bark surface to achieve more complete compression of the whole bark area and hence more complete bark separation, and (b) a drive train arrangement 52 to be included between the central planes of rotation of the rollers.

The use of narrow rollers instead of the more conventional wide rollers is preferred because narrow rollers enable irregularities in the log to be handled more easily. To change the pitch of the roller assemblies, electric motors or stepped hydraulic motors may be used.

FIG. 6 shows a preferred form of the bogie-mounted rollers of the equipment illustrated in FIG. 4. In this arrangement, a pair of narrow rollers 50 and 51, with their associated driving motors 53 and 54 are mounted on a support member 55. The support member 55 is connected via swivel axle 59 to a generally U-shaped support bracket 57 having side arms 57A. The support bracket 57 is supported by pivot pins 58 on a pair of arm members 56 which are, in turn, supported on an axle 15 mounted on the frame of the debarking equipment. The operation of the embodiment of FIG. 6 will be evident from the above description. Note, however, the preferred arrangement of the offset rollers 50 and 51, with the sides thereof adjacent to their respective driving motors aligned with the line B—B of FIG. 6.

Figure 7:
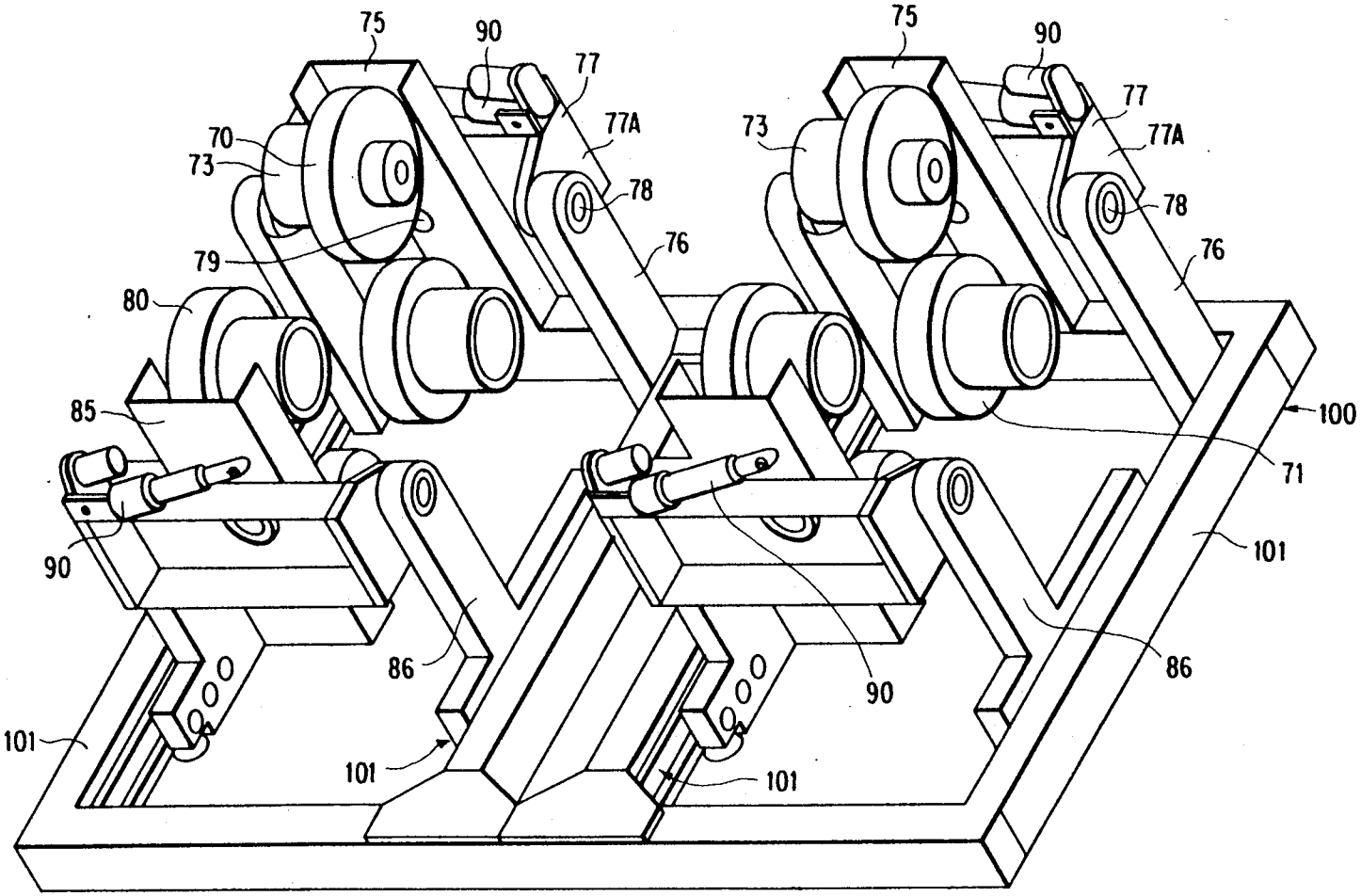
FIG. 7 is a perspective sketch illustrating an embodiment of the present invention for use with tree felling equipment.

FIG. 7 illustrates a prototype of the present invention that has been constructed to demonstrate how the present invention may be used in association with tree felling equipment, to permit felled trees to be debarked at the point of felling in a forest (thus enabling more logs to be transported from the forest in a single load of a timber forwarder. In the FIG. 7 embodiment, the fixed single rollers 10, 30 and 40 shown in FIGS. 2, 3 and 4 are each replaced with a second pair of rollers 70 and 71, mounted in a bogie-like arrangement on a support member 75. The support member 75 is connected by a swivel axle 79 to a generally U-shaped support bracket 77 having a pair of side arms 77A (defining the upright arms of the "U"). The side arms 77A are pivotally mounted on pivot pins 78 that are mounted on respective frame arms 76 that are rigidly affixed to a base frame 100. In a similar manner, the rollers 50 and 51 of the FIG. 4 embodiment have their equivalent in the rollers 80 and 81, mounted in a bogie-like arrangement on a support member 85. The mounting of the support member 85 in the equipment is similar to the mounting of the support member 75, except that the fixed frame arms 76 are replaced with arms 86 which are mounted in known manner, as illustrated, for movement along supporting cross-members 101 of the base frame 100. The rollers 70, 71, 80 and 81 are each driven by a respective motor 73.

The changing of the pitch of the rollers 70, 71, 80 and 81 is effected by respective hydraulically controlled linear actuators 90, mounted on the support brackets 77 and extending to the associated support member 75 or 85. However, other forms of linear actuator, or equivalent mechanical or electro-mechanical linkage arrangements may be used in place of the hydraulically controlled linear actuators 90. Linear actuators are well known in this art. A convenient recently published reference which describes a range of known mechanical linkages (including linear actuators) is the book entitled *Pneumatic Control for Industrail Automation*, by Peter Rohner and Gordon Smith, published by John Wiley & Sons in 1987.

Hydraulically controlled linear actuators are also used in the prototype equipment illustrated in FIG. 7 to control the to and fro movement of the arms 86 on the cross-members 101 and the titling, through 90°, of the base frame 100 relative to the bed member on which it was mounted. Again, alternative linkage arrangements (mechanical or electro-mechanical) may be used instead of hydraulically controlled linear actuators, if desired.

When using the equipment shown in FIG. 7, it was found that if steel rollers are used, when the pitch of the rollers is varied, the sharp edges of the rollers can dig into the central timber of the log and mark it. This also means that the pressure is being applied to the bark over a small area, and in some instances this has resulted in incomplete separation of the bark from the log. Thus a modified roller has been developed for use in this type of equipment. The modified roller is illustrated in FIG. 8.

Figure 8:
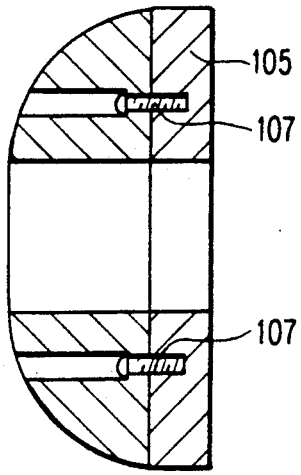
FIG. 8 is a sectional view through a preferred form of roller for the embodiment of FIG. 7.

The roller of FIG. 8 comprises a face plate 105 on which is mounted an annular thick disc 106 of polyurethane material. The disc 106 may be bonded to the face plate 105 or it may (as shown in FIG. 8) be held in rigid contact with the face plate by a plurality of bolts 107. This illustrated mounting arrangement permits ready exchange of the disc 106 when it is worn or needs (for any other reason) to be replaced. The face plate is mounted in a conventional manner for rotation by a motor. The disc 106 is preferably machined so that its outer surface is part of a sphere, having a radius substantially the same as the radius of the face plate. With this form of disc 106, as the pitch of the rollers is varied, bark on the log is always substantially tangential to the roller surface.

It has also been found, from using the prototype equipment illustrated in FIG. 7, that all of the rollers should have the same diameter, each of the rollers should be driven by a respective associated motor, and all of the pitch angles of the rollers should be the same, otherwise a build up of bark can occur and jam the equipment. In the prototype equipment, a suitable motor speed was found to be one which rotated the rollers at a rate of 60 revolutions per minute.

Figure 9:
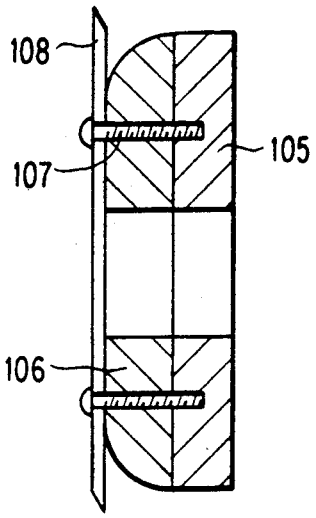
FIG. 9 illustrates a roller of the type shown in FIG. 8, fitted with bark cutting means.

To include a cutting mechanism for the bark of the log, the rollers illustrated in FIG. 8 can be modified to the form shown in FIG. 9. The roller of FIG. 9 has a steel cutting disc 108 mounted on the polyurethane thick disc 106. It has been found that it is preferable to have a roller of the FIG. 9 type as one of the lead-in rollers, to cut the bark before it is compressed. This arrangement gives a better effect than cutting the loosened tube of bark after it has been separated from the central timber of a log by the pressure applied by the rollers.

The equipment illustrated in FIG. 7, fitted with rollers of the type illustrated in FIGS. 8 and 9, has been found to be particularly effective for the removal of bark from logs having tight bark or stringy bark, which are difficult to debark by other techniques.

When the embodiment of FIG. 7 is incorporated into tree felling equipment, it will be mounted on a bed member attached to a prime mover, with the base frame 100 inclinable through at least 90° relative to the prime mover. To fell and debark a tree, the prime mover is moved towards the tree with the plane of the base frame substantially vertical and the arms 76 and 86 widely separated. The arms 86 should be fully retracted until each of the rollers 70 and 71 contact the tree trunk. The arms 86 will then be moved so that the rollers 80 and 81 also contact the tree trunk, after which the continued application of hydraulic pressure by the ram which controls the movement of the arms 86 causes each set of four rollers to clamp the trunk between them.

When the selected tree has been gripped by the two sets of rollers, the tree is cut using (for example) a chain saw mechanism mounted below the "jaws" of the debarking equipment. After the tree has been cut, the entire felling assembly (including the debarking equipment) will be raised and the motors powering the debarking equipment will be activated. This will result in the tree trunk being moved through the debarking equipment. Initially, the severed trunk of the tree will be held by the rollers and rotated by them with the rollers having zero pitch (that is, the angle A of FIG. 4 will be 90°). This rotation will detach the bark under the rollers and also most (sometimes all) of the bark below the bottom set of rollers and above the cut end of the trunk. The pitch angle of the rollers will then be changed so that the tree trunk moves vertically downwards under the action of the debarking rollers.

In the case of tall trees, after downward movement of the trunk for about three meters, the chain saw mechanism below the jaws of the debarking equipment will be activated to remove the debarked length of trunk. Some tilting of the felling assembly may be necessary as the trunk is moved downwards, to prevent it striking the ground or other obstacles.

The downward movement of the tree trunk (now less heavy as the lowest portion has been removed) and its debarking are continued, and three meters lengths (or thereabouts) of the trunk are progressively removed. As this process proceeds, the mass of tree being carried by the rollers decreases, and the speed of rotation of the remaining trunk and the pitch angle of the rollers may be increased. A feature of this type of tree felling assembly is that delimbing equipment is normally provided to remove branches from the felled tree. The delimbing equipment may comprise a short chain saw or circular saw, mounted above the debarking equipment with the plane of the bar of the short chain saw, or the circular blade, parallel to the direction of movement T of the log (trunk) as in FIG. 4. The short chain saw or circular saw can then be used to cut branches close to the trunk as the trunk of the felled tree is moved past the short chain saw or the circular saw. With this feature added, even pine trees with many branches can be delimbed as they are felled and debarked, prior to being loaded on a timber jinker or trailer for transportation.

Another use of the present invention is in a mill in which logs are debarked. In such a mill installation, a modified form of the arrangement shown in FIGS. 2 to 6 may be used with the "bogies" fixed in a lower position so that logs can be fed on to the double rollers of the "bogies" of the first set of rollers. The single rollers of each set of rollers can then be swung on respective arms to contact the bark of the log as it passes through the debarking equipment.

Figure 10:
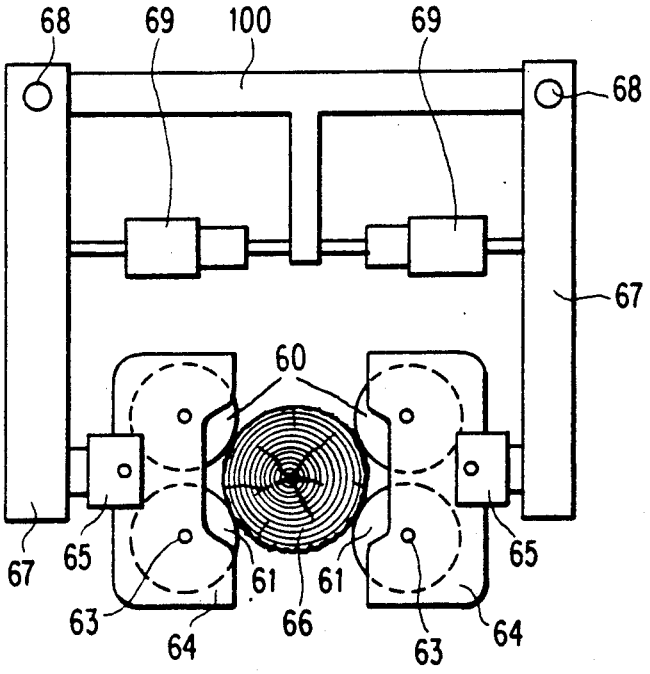
FIG. 10 illustrates a schematic mill installation of equipment that is essentially the same as the embodiment illustrated in FIG. 7.
Figure 11:
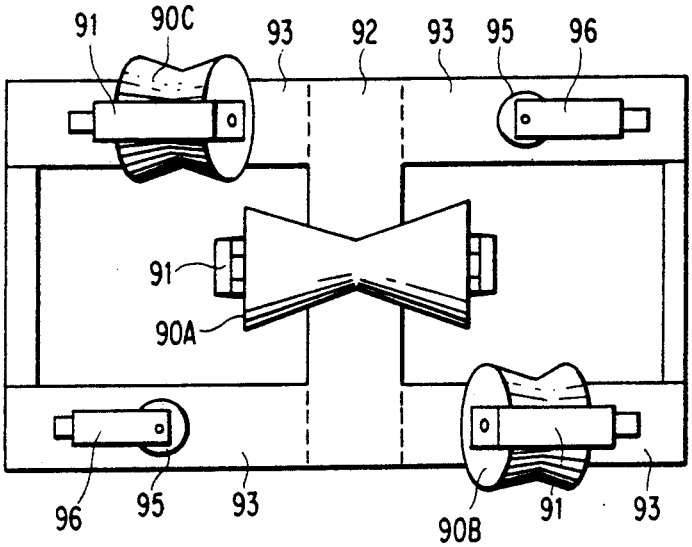
Figure 12:
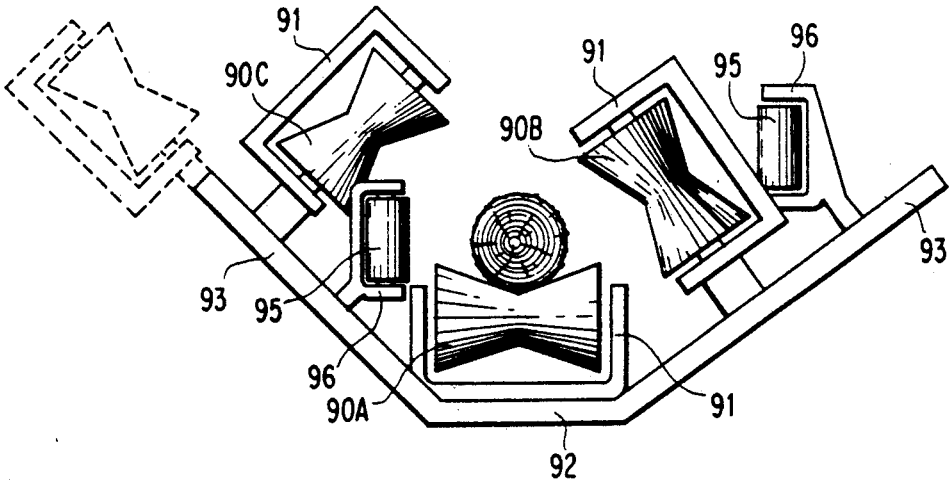

An example of the use in a mill installation of an arrangement having features which are similar to those of the unit shown in FIG. 7 is illustrated in FIG. 10. In the FIG. 10 arrangement, each set of rollers comprises two pairs of rollers 60 and 61. The pairs of rollers 60 and 61 are each mounted in a bogie-like arrangement, for rotation about respective axles 62 and 63, journalled in respective support members 64. Each support member 64 is pivotally mounted on a respective support bracket 65 which is rotatably mounted at or near one end of an associated arm 67. Each arm 67 is connected at its other end, through a swivel pin 68, to a framework 100. Hydraulic rams 69 control the movement of the arms 67 relative to the frame 100, and the application of pressure, via the rollers 60 and 61, to the bark of the log 66.

An advantage of a pressure debarking mill installation of the type shown in FIG. 10 is that bark stripped from the log 66 will fall clear of the rollers 60 and 61, thus minimizing the likelihood of bark jamming the debarking installation.

In both the tree felling and the mill applications of the present invention, provision has to be made to ensure that the rollers have sufficient resilience of grip upon the log, as pressure is applied, to prevent the debarker being jammed when the surface topography of a log changes suddenly. Sudden variations in diameter occur as a result of swellings (usually asymmetrical) in the log and the presence of the stubs of branches if the preferred delimbing equipment is not used. In addition, the roller assemblies should maintain pressure on the log as its diameter reduces (which happens due to the natural taper of the trunks of trees). When a hydraulic ram is used to move the roller assemblies and apply pressure to a log, the conventional approach of including an accumulator in the hydraulic circuit will ensure that the rollers adjust to take up the taper in a log and permit the passage of sudden discontinuities on the outer surface of the log. Known pressure-limiting mechanism can be used with rack and pinion and with worm and nut movement and pressure applying mechanism, if such mechanisms are used instead of hydraulic rams.

In case jams in the debarking equipment do occur, or to enable a second compression to be applied over a surface region of a log if all the bark is not separated from the wood underneath it, the motors driving the rollers are reversible. Reversing the direction of rotation of the rollers without changing the pitch setting of the rollers will result in the direction of movement of a log through the debarking equipment being reversed.

Those skilled in the art will appreciate that although several embodiments of the present invention have been described above, variations to such embodiments may be made without departing from the present inventive concept.

We claim:

1. Apparatus for the compression debarking of logs comprising:

(a) a first set of rollers and at least one further set of rollers, said sets of rollers being mounted in spaced apart relationship, each set of rollers defining an aperture through which a log may pass as it transverses the apparatus; each set of rollers comprising:

(i) a first roller and a second roller mounted for rotation about respective, spaced apart, parallel axles supported in a bogie-like arrangement by a first support member, said first support member being moveable relative to a support frame and to a log positioned in said aperture, to enable said first and second rollers to apply pressure to the log; and (ii) at least one further roller but not more than two further rollers, said at least one further roller being mounted for rotation about a respective axle supported by a second support member which is fixed in relation to said support frame, said at least one further roller applying pressure to the log as a consequence of the pressure applied to the log by the first and second rollers;

(b) motor means to drive at least said first and second rollers of each set in the same direction of rotation about their respective axles;

(c) respective movement means associated with each set of rollers to cause its associated first support member to move the respective first and second rollers towards and away from the log and to apply pressure thereto; and (d) cutting means adapted to cut through the bark of the log.

2. Apparatus as defined in claim 1, in which the cutting means comprises at least one cutting blade on the outer surface of a roller of the final set of rollers of the apparatus.

3. Apparatus as defined in claim 2, in which each said movement means comprises a hydraulic ram.

4. Apparatus as defined in claim 1, in which said motor means is able to reverse the direction of rotation of the rollers.

5. Apparatus as defined in claim 1, in which there are two sets of rollers.

6. Apparatus as defined in claim 5, in which there are two further rollers in each set of rollers.

7. Apparatus as defined in claim 6, in which the pairs of rollers, namely the first and second rollers of each set of rollers and the two further rollers of each set, are each mounted in a respective bogie-like arrangement with an associated support member, each support member being connected by a swivel axle to an associated support bracket having a pair side arms, each of said support brackets being pivotally mounted on a pair of frame arms by pivot pins passing through said side arms.

8. Apparatus as defined in claim 7, in which said apparatus includes a base frame, the frame arms on which each pair of said further rollers are mounted being fixedly connected to said base frame, and the frame arms on which each pair of said first and second rollers are mounted being moveable by said movement means towards and away from said fixedly mounted frame arms along respective pairs of cross-members of said base frame.

9. Apparatus as defined in claim 8, in which each roller is driven by a respective, reversible motor.

10. Apparatus as defined in claim 9, including means to vary the pitch of each roller relative to the longitudinal axis of a log passing through the apparatus.

11. Apparatus as defined in claim 10, in which each roller of the apparatus comprises an annular steel face plate on which is mounted an annular thick disc of a polyurethane material, said thick disc being so shaped that the surface of each roller which contacts the bark of a log passing through said apparatus is substantially part of a sphere have a diameter substantially equal to the outer diameter of said face plate.

12. Apparatus as defined in claim 11, in which said base frame is mounted on a bed member which forms part of a tree felling apparatus, said tree felling apparatus including saw means for cutting through a tree trunk and delimbing equipment, said base frame being inclinable relative to said bed member through an angle of at least 90°.

13. Apparatus as defined in claim 1, in which the pitch of each roller is variable, and each roller is driven by a respective motor.

14. Apparatus as defined in claim 13, in a mill installation, in which there are two further rollers in each set of rollers and the first and second rollers of each set of rollers and the two further rollers of each set of rollers are mounted in respective bogie-like arrangements with associated support members at or near the lower ends of substantially vertical frame arms, each of said frame arms being pivotally connected at or near its upper end to a main frame, a respective hydraulic ram being connected between each frame arm and said main frame to move said frame arms to enable said bogie-mounted rollers to be moved relative to a log passing through said apparatus and to grip and apply pressure to the bark of such a log.

* * * * *

UNITED STATES PATENT AND TRADEMARK OFFICE

CERTIFICATE OF CORRECTION

PATENT NO. : 5,022,446

DATED : June 11, 1991

INVENTOR(S) : Robin WINGATE-HILL & Ian J. MacARTHUR

It is certified that error appears in the above-identified patent and that said Letters Patent is hereby corrected as shown below:

Title page, item [30] should be corrected to read as follows:

--[30] Foreign Application Priority Data

Oct. 20, 1987 [AU] Australia ..... PI4967--.

Signed and Sealed this

Eighth Day of December, 1992

*Attest:*

*Attesting Officer*

DOUGLAS B. COMER

*Acting Commissioner of Patents and Trademarks*